United States Patent [19]

White

[11] 4,232,716

[45] Nov. 11, 1980

[54] WASTE SOLVENT COLLECTOR

[75] Inventor: Bob B. White, St. Petersburg, Fla.

[73] Assignee: Honeywell Inc., Minneapolis, Minn.

[21] Appl. No.: 1,572

[22] Filed: Jan. 8, 1979

[51] Int. Cl.[3] ..... B65B 3/06; B65B 39/12

[52] U.S. Cl. ..... 141/98; 53/390; 141/344; 141/379; 220/262

[58] Field of Search ..... 53/390; 141/1, 98, 310, 141/311 R, 326, 331–345, 379, 344; 215/296, 307, 311; 220/262, 263, 264, 254, 255, 256

[56] References Cited

U.S. PATENT DOCUMENTS

| | | | |
|---|---|---|---|
| 474,674 | 5/1892 | Miller | 141/336 X |
| 579,649 | 3/1897 | Lackenbach | 141/336 X |
| 1,286,236 | 12/1918 | Conway | 141/336 X |
| 1,364,759 | 1/1921 | Hodges | 141/337 X |

*Primary Examiner*—Frederick R. Schmidt
*Attorney, Agent, or Firm*—Albin Medved

[57] ABSTRACT

An apparatus for collection of liquid waste solvents into a container, including convenient means for opening and closing the container and for positioning a funnel. Both functions of opening the container and positioning of the funnel are accomplished by a single handed one step operation of a lever, thus leaving the other hand free for pouring of the liquid into the funnel. After pouring the liquid, the container can be sealed by a simple release of the lever.

5 Claims, 3 Drawing Figures

WASTE SOLVENT COLLECTOR

BACKGROUND OF THE INVENTION

1. Field of the Invention

The present invention pertains to an apparatus for collecting waste solvents. In the manufacture of electronic or optical instrument assemblies, various cleaning solvents are used. It is often desirable to collect waste solvents used for this purpose and to maintain such waste solvents in separate containers for subsequent reclamation or disposal. It is also desirable, after being collected, to maintain these solvents in sealed containers so as to prevent the escape of vapors into the atmosphere. In many cases, such vapors are toxic and therefore need to be controlled. In other cases, the evaporation of the solvent may merely be wasteful.

2. Description of the Prior Art

Prior to this invention, the pouring of liquids into sealed containers comprised an operation of several steps. First, the container had to be opened, a funnel had to be inserted into the container and held, and after pouring the liquid into the container the funnel had to be removed and the container cover replaced. This procedure was time consuming and awkward and thereby discouraged proper collection and storage of waste solvents.

SUMMARY OF THE INVENTION

The present invention pertains to an apparatus for collecting waste solvents. More particularly the present invention provides a convenient means for collecting waste solvents in a container having the feature of being easily opened while the liquid is being poured into the container and being sealed to prevent the escape of fluid vapors during the time that the fluid is being stored.

The apparatus according to the present invention comprises a container having a top opening, a funnel positioned in the top opening of the container, a closure member located inside the funnel, and means for holding the funnel and the closure member in such a way that the top opening of the container is normally sealed. Means are provided, operable by a single hand, for opening the closure member and for simultaneously lifting the funnel a short distance above the top opening to allow the passage of liquid through the funnel into the container and to allow the venting of the container via the space between the outside surface of the funnel and the perimeter of the top opening of the container.

It is therefore an object of the present invention to provide a convenient means for collecting and storing waste solvents. More particularly, it is an object of the present invention to provide an apparatus which permits, by use of a single hand, the opening of a container and positioning of a funnel for pouring a liquid into the container and thereafter repositioning the funnel and closing the container. The specific advantages of the present invention will become apparent to those skilled in the art upon examination of the following specification, claims, and drawing.

DESCRIPTION OF THE PREFERRED EMBODIMENT

Figure 3:
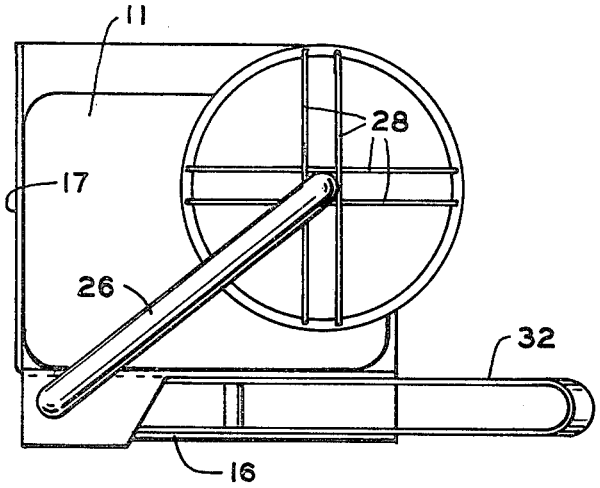
FIG. 3 illustrates the top view of the preferred embodiment of the present invention.
Figure 1:
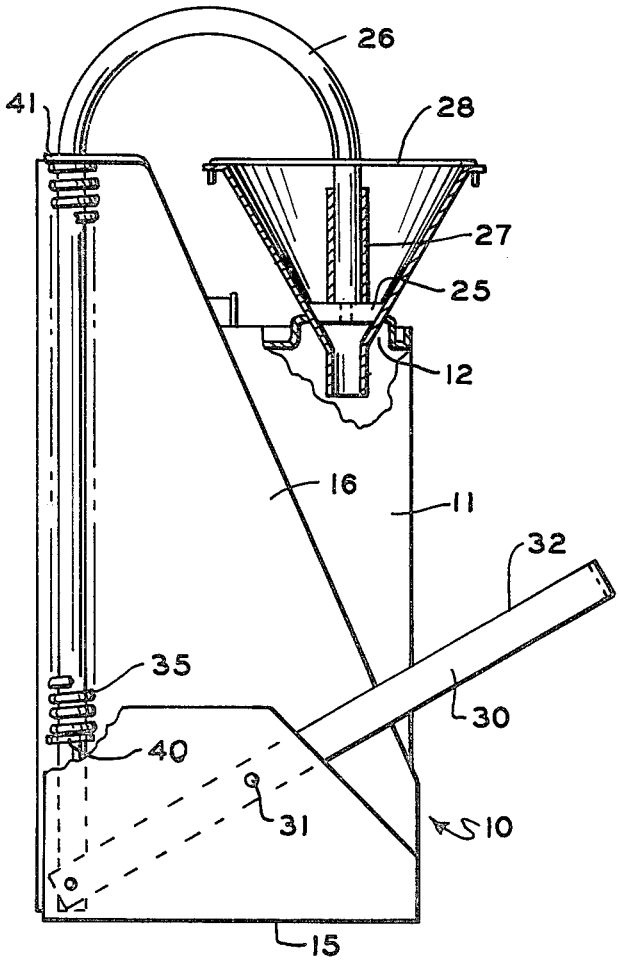
FIG. 1 of the drawing illustrates a side view of the preferred embodiment of the present invention.
Figure 2:
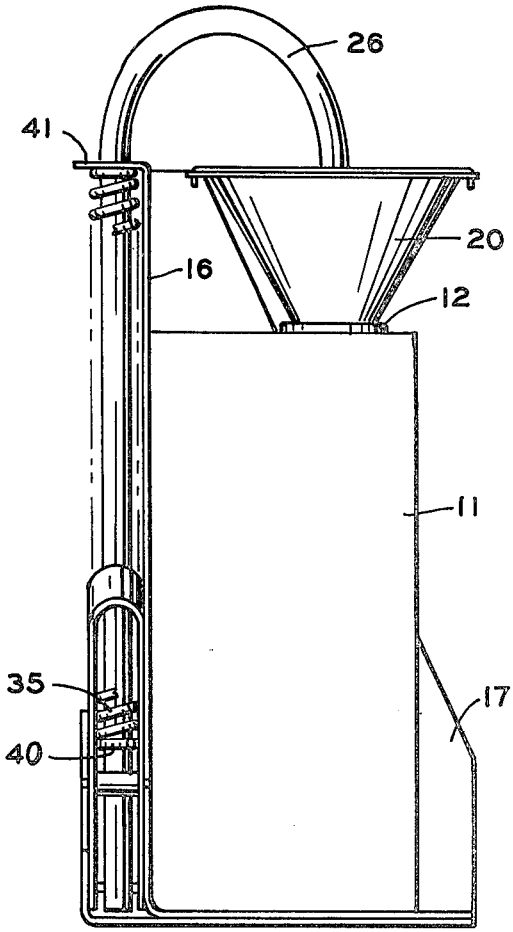
FIG. 2 illustrates the front view of the preferred embodiment of the present invention.

Referring to FIGS. 1, 2, and 3, a support structure 10 is shown having a base 15 and vertical wall extensions 16 and 17. A container 11 having a top opening 12 is positioned on base 15 of support structure 10. Rectangular, one gallon containers of the type generally available on the market have been found convenient for this purpose. A funnel 20 is positioned in the top opening 12, funnel 20 being of conical shape so that when the funnel rests firmly on the circular rim of opening 12 a seal is produced between the rim and the funnel.

A stopper 25 is positioned within funnel 20, stopper 25 having the function of sealing the funnel so as to prevent fluid flow through the funnel when the stopper is resting snugly in contact with the inside wall of the funnel. Stopper 25 is attached to a rod 26 which extends upward over the top of funnel 20 and then curves towards wall 16 of support structure 10 and then downward in a vertical direction along wall 16 towards base 15. Rod 26 is mounted on support structure 10 for freedom of motion along the vertical direction between first and second positions. The lower end of rod 26 is connected to one end of a lever 30. Lever 30 is attached to wall 16 at a pivot point 31 for a rotational freedom of motion about pivot point 31 in a plane parallel to wall 16. The other end of lever 30 is a handle 32 which extends beyond the front edge of base 15 and container 11.

A spring 35 is mounted on rod 26 between an abutment 40 at the lower end of rod 26 and a bracket 41 at the upper end of vertical wall extension 16. Spring 35 functions to normally bias rod 26 towards the first, lower position. As handle 32 of lever 30 is pushed downwards, pressure is applied against spring 35, moving rod 26 towards the second, upper position. The upward motion of rod 26 results in the raising of stopper 25 within funnel 20, and thereby opening the funnel for transmitting fluid to container 11.

A sleeve 27 is positioned on rod 26 next to stopper 25. The dimensions of sleeve 27 are such that the top end of the sleeve is a short distance below the top rim of funnel 20 when rod 26 is in the lower position and stopper 25 rests in contact with funnel 20. As rod 26 is raised, the upper edge of sleeve 27 engages a set of wires 28 (shown more clearly in FIG. 3) strung across the top of funnel 20. As rod 26 is lifted further, funnel 20 is raised by sleeve 27 and wires 28 to create a clearance between the outside wall of funnel 20 and the rim of top opening 12 of container 11. The purpose of this clearance between the rim and the funnel is to allow venting of container 11 while liquid is being poured through the funnel into the container. As handle 32 of lever 30 is released, the action of spring 35 moves rod 26 downward, simultaneously lowering funnel 20 and stopper 25 to reestablish the seal between the funnel and the container, as well as sealing the inside passage of the funnel, to thereby prevent the escaping of vapors from container 11 while liquid is being stored.

As described above, the single handed operation of handle 32 makes it possible to open the container, position the funnel and open a venting aperture for pouring liquid into container 11, and thereafter to replace the funnel and seal the container. The other hand is left free for pouring the liquid.

In practical use, several collection devices of the type described above are used side by side, for collection of different solvents or to provide additional capacity for the same solvent.

A unique and improved apparatus for collecting liquid solvents has been shown and described in the foregoing specification. Various modifications of the inventive concepts will be obvious to those skilled in the art, without departing from the spirit of the invention. It is intended that the scope of the invention be limited only by the following claims.

What is claimed is:

1. An apparatus for collection of liquid into a container having a top opening, said apparatus comprising:

a support structure including a base for supporting said container, a funnel having an upper end with an opening for receiving fluid, and a lower end for insertion into said top opening of said container, the outside contour of the funnel being complimentary to the geometry of said top opening of said container such that as the funnel is lowered it comes to rest on the rim of said top opening and produces a seal between the funnel and the container;

a closure member positioned inside said funnel for opening and closing a fluid passage through said funnel; and means, mounted on said support structure, operable to engage said closure member and said funnel for opening said closure member to allow passage of fluid through the funnel and simultaneously lifting the funnel from said top opening of said container through a sufficient distance to provide a clearance between said funnel and said container and thus allow venting of the container while fluid is poured through said funnel.

2. An apparatus according to claim 1 wherein the outside surface of said funnel is of a conical shape and the top opening in said container has a circular cross-section.

3. Apparatus according to claim 1 wherein said means operable to engage said closure member includes:

a rigid rod mounted on said support structure for freedom of motion between first and second positions;

means for engaging with said rod, said closure member, and said funnel such that when the rod is in the first position the closure member is closed and the funnel is resting firmly on the rim of the top opening of said container and when the rod is in the second position the closure member is opened and the funnel is lifted through sufficient distance to produce clearance between the funnel and the top opening for venting of the container while liquid is poured through the funnel; and a lever having one end connected to said rigid rod and having its other end extending beyond the front edge of said base, said lever being operable to rotate about a pivot point such that downward motion of said front extension of said lever causes a motion of said rigid rod towards the second position.

4. Apparatus according to claim 3, wherein means are provided for biasing said rigid rod towards said first position.

5. Apparatus according to claim 4, wherein said means for biasing said rod toward said second position is a spring.

* * * * *